United States Patent [19]

Carson et al.

[11] 4,318,368

[45] Mar. 9, 1982

[54] ORIFICING OF STEAM SEPARATORS FOR UNIFORM FLOW DISTRIBUTION IN RISER AREA OF STEAM GENERATORS

[75] Inventors: William R. Carson; Braj K. Singh, Hixson, both of Tenn.

[73] Assignee: Combustion Engineering, Inc., Windsor, Conn.

[21] Appl. No.: 220,597

[22] Filed: Dec. 29, 1980

[51] Int. Cl.[3] ..... F22B 1/06; B01D 53/26

[52] U.S. Cl. ..... 122/34; 122/492; 122/483; 55/344; 55/348

[58] Field of Search ..... 122/32–34, 122/491, 492, 483; 55/344, 348

[56] References Cited

U.S. PATENT DOCUMENTS

| | | | |
|---|---|---|---|
| 1,847,304 | 3/1932 | Bradshaw et al. | 55/344 |
| 1,884,501 | 10/1932 | Andrews et al. | 55/344 |
| 3,066,088 | 11/1962 | Blaser | 122/491 |
| 3,720,046 | 3/1973 | Kudirka et al. | 55/344 |
| 3,735,569 | 5/1973 | Micheller et al. | 55/348 |
| 4,162,150 | 7/1979 | Carson | 122/492 |

*Primary Examiner*—Henry C. Yuen

*Attorney, Agent, or Firm*—Robert L. Olson

[57] ABSTRACT

A vertical shell-and-tube steam generator (10) which has a plurality of U-shaped tubes (60,62) through which the heating fluid flows, vaporizing fluid flowing on the outside of the tubes. A plurality of separators (26) are located above the tubes to remove liquid from the generated vapor. Orifices are located in some of the separator inlets (22) located above the hot leg region (60) of the U-tubes reducing the problem of overloading of these separators (26) by accomplishing a more uniform flow distribution of vapor from the areas above both the hot (60) and cold (62) legs of the U-tubes.

3 Claims, 3 Drawing Figures

ORIFICING OF STEAM SEPARATORS FOR UNIFORM FLOW DISTRIBUTION IN RISER AREA OF STEAM GENERATORS

BACKGROUND OF THE INVENTION

A typical tube-and-shell steam generator being used in nuclear steam generators has a vertical vessel which houses a plurality of U-shaped tubes. Heating fluid enters one leg (hot leg) of these tubes, and leaves via the other leg (cold leg), giving up heat in the process to vaporize a fluid flowing on the outside of the tubes. A deck or plate is located above the tubes, on which a plurality of water-steam separators are located. These separators remove the water from the steam-water mixture, returning the water to the bottom of the vessel through a downcomer.

Because the heating fluid is hotter in the hot leg than the cold leg of the U-tubes, more steam is generated on the hot leg side of the steam generator than the cold leg side. This maldistribution causes overloading of the separators on the hot leg side. The steam flow rate is maximum at the extreme of the hot leg region. This can cause excessive moisture carryover with the steam exiting from the separators.

SUMMARY OF THE INVENTION

In accordance with the invention, orifices are provided in the inlet of some of the separators on the hot leg side of a nuclear steam generator utilizing U-tubes for carrying the heating fluid. This accomplishes fairly uniform steam flow distribution in the riser area above the tube bundle in the steam generator. The orifice sizing is varied to accomplish the best flow distribution.

DESCRIPTION OF THE PREFERRED EMBODIMENT

Figure 1:
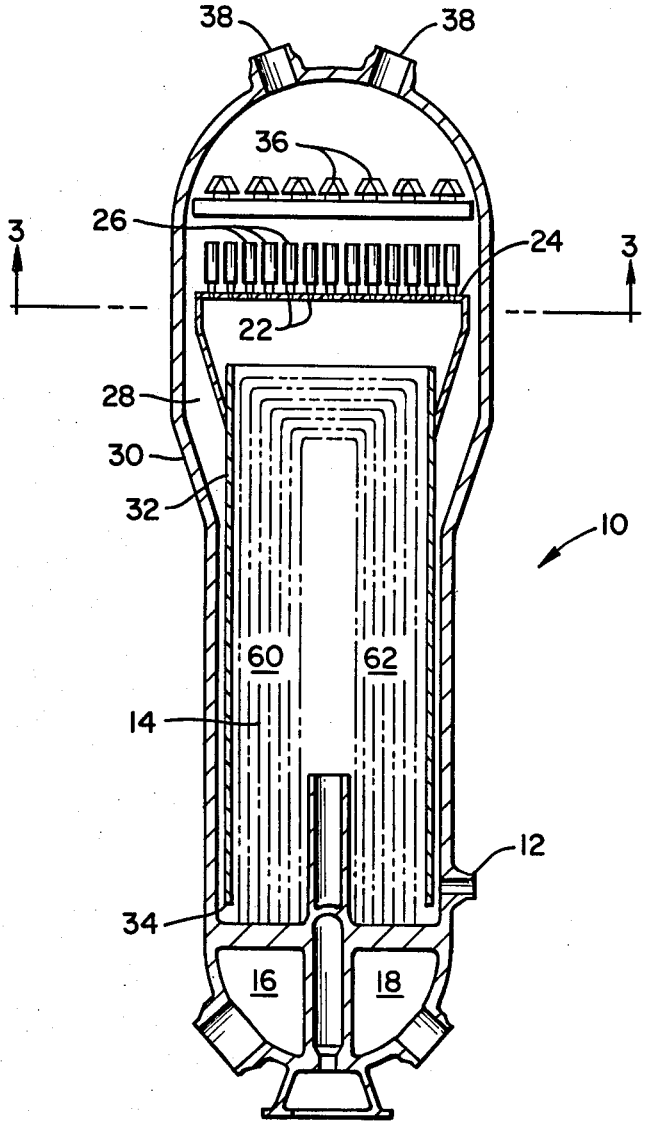
FIG. 1 is a vertical section of a shell-and-tube type of vapor generator incorporating the invention.

Looking now to FIG. 1 of the drawing, 10 designates a shell-and-tube type saturated steam generator in its entirety. Feedwater enters the generator vessel through inlet 12 and flows upwardly through the vessel on the outside of the U-tubes 14, absorbing heat therefrom. The heating medium enters tubes 14 from inlet manifold 16 and exits by way of outlet manifold 18. The water, after being heated to the point where some steam has been generated, rises upwardly and passes through openings 22 in plate 24, into the centrifugal separators 26 where most of the water is separated out of the steam. The separated water flows along the upper surface of plate 24, falling off the peripheral edge thereof into the annular downcomer 28. Annular downcomer 28 is formed by the shell 30 on the outside and shroud 32 on the inside. Water flows downwardly through downcomer 28 below the lower edge 34 of shroud 32 to be passed upwardly through the heating section of the generator again. The steam leaving the centrifugal separators 26 flows through a plate drier section 36, where any moisture remaining in the now relatively dry steam is removed. The dried steam exits through outlets 38 to its ultimate point of use, for example a turbine.

Figure 2:
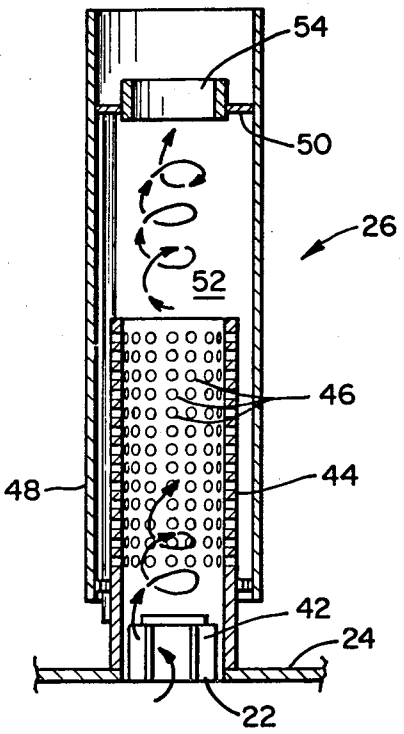
FIG. 2 is an enlarged view of a centrifugal separator used in the vapor generator of FIG. 1.

Looking now to FIG. 2, one separator 26 is shown in an enlarged view. Each of the separators are identical and connected at their bottom ends to plate 24. An opening 22 in plate 24 allows the steam-water mixture to enter the separator. The mixture passing upwardly through the opening 22 encounters a spinning vane assembly 42, positioned in the lower portion of cylindrical member 44, which causes the mixture to flow spirally upward. Above the spinning vane 42, there are a large number of holes 46 in the walls of the cylindrical member 44. These holes 46 allow much of the water to separate out due to centrifugal force. This separated water impinges on the walls of housing 48 running downwardly thereon, and falls off the lower edges of housing 48 onto the upper surface of plate 24.

The steam-water mixture exiting from the top of cylindrical member 44 expands into the chamber 52. Since there is appreciable spin left in the flow, a large porportion of the remaining water in the steam is thrown outwardly onto the walls of housing 48. The remaining mixture, now containing 2–3% water, exits the separator through circular opening 54 in plate 50.

There is a maldistribution of the steam-water mixture below plate 24 since a great deal more steam is generated in the "hot leg" portion 60 (FIG. 1) of the steam generator than in the "cold leg" portion 62. The heating fluid is much hotter in the leg 60 of the U-tubes above the inlet 16 than it is on the other side, since the fluid has already given up a considerable amount of heat to the fluid being heated in the vessel by the time it reaches the cold leg. This imbalance would normally cause overloading of some of the centrifugal separators 26 on the "hot leg" side 60 of the generator, causing some undesirable carryover of water out of the generator. To overcome this problem in accordance with the invention, some of the inlets 22 to the separators 26 on the hot leg side 60 of the generator have orifices placed in them. This causes more of the steam-water mixture to flow over to the cold leg side, alleviating the imbalance problem.

Figure 3:
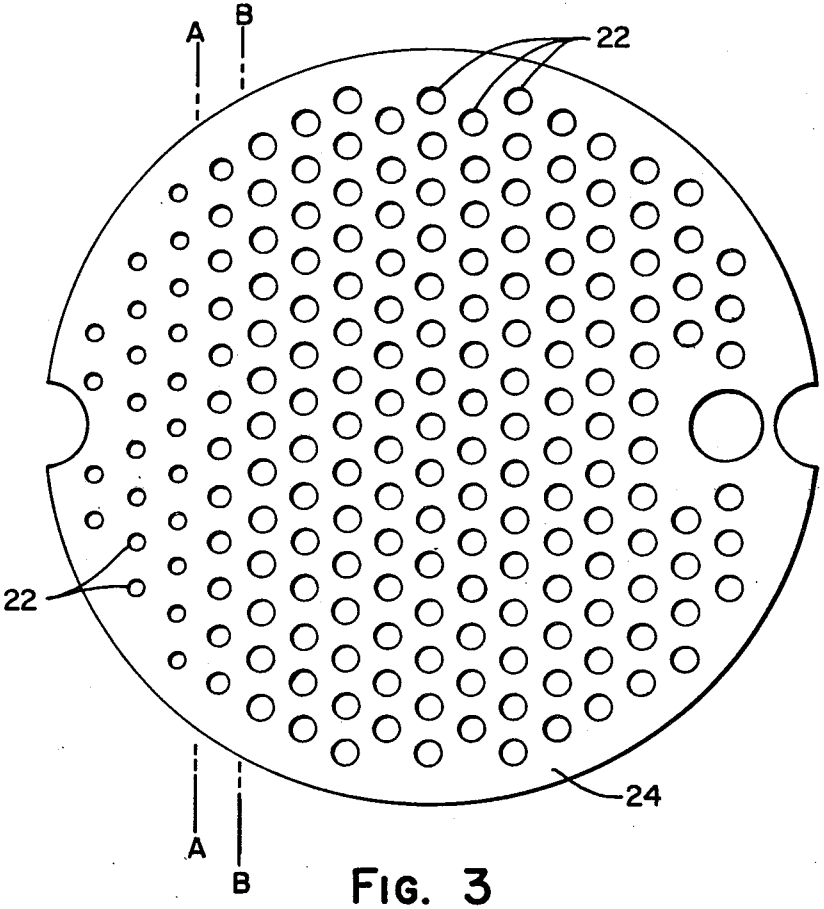
FIG. 3 is an enlarged view taken on line 3—3 of FIG. 1.

Looking now to FIG. 3, the openings in the plate 24 leading into the centrifugal separator 26 is shown. As can be seen, the opening 22 to the left of line A—A are the smallest. The openings between lines A—A and B—B are medium sized. The openings to the right of line B—B are the largest. The openings on the left half of the vessel are on the hot leg side. For best operation, approximately 15–20% of all of the openings 22 should be $4\frac{1}{2}''$ in diameter, as shown to the left of line A—A. Apprximately 10–15% of the total openings should be 5" in diameter, as shown between line A—A and line B—B. The remainder of the openings, to the right of line B—B are unrestricted, and are 6" in diameter.

We claim:

1. A shell-and-tube heat exchanger for the generation of vapor by the indirect transfer of heat from a heating fluid to a vaporizable liquid comprising a generally vertically elongated cylindrical shell, transversely extending tube sheet means dividing the interior of said shell into a vapor generating chamber and heating fluid chamber means, a vertical plate dividing the heating fluid chamber means into an inlet chamber and an outlet chamber, a bundle of U-shaped heat exchange tubes having their inlets connected to the inlet chamber and their outlets connected to the outlet chamber, for circulating heating fluid through said tubes, means for supplying vaporizable liquid to said vapor generating chamber, a separator deck extending transversely across said shell above the tube bundle, a plurality of openings in said deck, a plurality of water-steam separators having their inlets connected to the openings in the deck, some of the separator inlets located directly above the heating fluid inlet chamber being of smaller cross-sectional flow area than those above the heating fluid outlet chamber, and said some of the separator inlets having smaller cross-sectional flow area are those furthest removed from the heating fluid outlet chamber.

2. The shell-and-tube heat exchanger set forth in claim 1, wherein the separator deck covers substantially all of the cross-sectional flow area of the shell, and the plurality of water-steam separators are substantially equally spaced apart, and cover substantially all of the cross-sectional flow area above the deck.

3. The shell-and tube heat exchanger set forth in claim 2, wherein said some of the separator inlets having smaller cross-sectional flow area have orifices therein.

* * * * *